US008188929B2

(12) United States Patent
Oh et al.

(10) Patent No.: US 8,188,929 B2
(45) Date of Patent: May 29, 2012

(54) SELF-RESONATING ANTENNA

(75) Inventors: Sung-Hoon Oh, Plantation, FL (US); Soo Won Hong, Vernon Hills, IL (US); Mattia Pascolini, Plantation, FL (US)

(73) Assignee: Motorola Mobility, Inc., Libertyville, IL (US)

( * ) Notice: Subject to any disclaimer, the term of this patent is extended or adjusted under 35 U.S.C. 154(b) by 914 days.

(21) Appl. No.: 12/128,681

(22) Filed: May 29, 2008

(65) Prior Publication Data

US 2009/0295646 A1 Dec. 3, 2009

(51) Int. Cl.
*H01Q 1/24* (2006.01)

(52) U.S. Cl. ..... 343/702; 343/700 MS; 343/767

(58) Field of Classification Search ..... 343/700, 343/702, 749, 767
See application file for complete search history.

(56) References Cited

U.S. PATENT DOCUMENTS

| | | | | |
|---|---|---|---|---|
| 2,505,751 | A * | 5/1950 | Bolljahn | 343/708 |
| 3,050,730 | A * | 8/1962 | Lamberty | 343/792.5 |
| 6,191,740 | B1 | 2/2001 | Kates et al. | |
| 6,215,447 | B1 | 4/2001 | Johnson | |
| 6,650,301 | B1 * | 11/2003 | Zimmerman | 343/803 |
| 6,677,909 | B2 | 1/2004 | Sun et al. | |
| 7,081,857 | B2 * | 7/2006 | Kinnunen et al. | 343/702 |
| 7,319,432 | B2 * | 1/2008 | Andersson | 343/702 |
| 7,973,726 | B2 * | 7/2011 | Tseng et al. | 343/702 |
| 2007/0120745 | A1 | 5/2007 | Yihong et al. | |

FOREIGN PATENT DOCUMENTS

| | | |
|---|---|---|
| DE | 32 46 365 A1 | 6/1984 |
| JP | 11/150415 A | 6/1999 |
| WO | 99/43037 | 8/1999 |
| WO | 02/50948 | 12/2001 |
| WO | 2004/001898 | 6/2003 |
| WO | 2008/059509 | 11/2007 |

OTHER PUBLICATIONS

ISR of PCT/US09144620.

* cited by examiner

*Primary Examiner* — Tho G Phan
(74) *Attorney, Agent, or Firm* — Mayback & Hoffman, P.A.; Gregory L. Mayback; Thomas Bethea

(57) ABSTRACT

An antenna includes a U-shaped radiator portion having a first extending arm and a second extending arm parallel and adjacent the first extending arm and coupled to the first extending arm by a junction portion, where the first and second extending arms and the junction portion defining a slot. The antenna further includes a ground plane physically coupled only to the first extending arm and a distributed feed element disposed at least partially within the slot and operable to radiate electromagnetic signals within a first frequency range and electrically excite at least portions of the radiator portion at at least a second frequency range having frequencies outside the first frequency range, thereby causing the radiator portion to radiate electromagnetic signals within the second frequency range.

14 Claims, 13 Drawing Sheets

SELF-RESONATING ANTENNA

FIELD OF THE INVENTION

This invention relates in general to antennas, and more particularly, to a multi-band antenna for use in hand-held devices.

BACKGROUND OF THE INVENTION

Wireless communication is the transfer of information over a distance without the use of electrical conductors or wires. This transfer is actually the communication of electromagnetic waves between a transmitting entity and remote receiving entity. The communication distance can be anywhere from a few inches to thousands of miles.

Wireless communication is made possible by antennas that radiate and receive the electromagnetic waves to and from the air, respectively. The function of the antenna is to "match" the impedance of the propagating medium, which is usually air or free space, to the source that supplies the signals sent or interprets the signals received.

Antenna designers are constantly balancing antenna size against antenna performance. Unfortunately, these two characteristics are generally inversely proportional. To make matters more difficult, consumers are now favoring cellular phones with internal antennas. The ever-shrinking size of cellular phones leaves little space inside the phone for these antennas. To add even more complexity to this communication problem, phones and other communication devices are needed that offer communication over multiple frequency ranges, requiring multiple and differing antenna elements within the device. With the reduction in antenna element real estate, communication performance suffers.

Therefore, a need exists to overcome the problems with the prior art as discussed above.

SUMMARY OF THE INVENTION

An antenna, in accordance with an embodiment of the present invention, includes a distributed feed element, a first coupler portion and a second coupler portion sandwiching the distributed feed element, a first resonant line portion having a first end physically coupled to a second end to the first coupler portion, a second resonant line portion having a second end physically coupled to a first end to the second coupler portion, a shunt portion coupling the second end of the first resonant line portion to a first end of the second resonant line portion, and a ground plane physically coupled only to the first end of a first coupler.

In accordance with another feature of the present invention, the first coupler portion, the second coupler portion, the first resonant line portion, the second resonant line portion, and the shunt open portion define a slot.

In accordance with yet another feature of the present invention, the slot is rectangular.

In accordance with still another feature of the present invention, the first coupler portion and the second coupler portion define an approximately 90-degree bend.

In accordance with another feature, the present invention includes an approximately 90-degree bend in the distributed feed element that coincides with the bend in the slot.

In accordance with yet one more feature, the present invention includes a capacitive element bridging the slot and capacitively coupling the first coupler portion to the second coupler portion.

The present invention, according to an embodiment, is an antenna that includes a U-shaped radiator portion having a first extending arm and a second extending arm parallel and adjacent the first extending arm and coupled to the first extending arm by a junction portion, the first and second extending arms and the junction portion defining a slot. The antenna further includes a ground plane physically coupled only to the first extending arm and a distributed feed element disposed at least partially within the slot and operable to radiate electromagnetic signals within a first frequency range and electrically excite at least portions of the radiator portion at at least a second frequency range having frequencies not within the first frequency range, thereby causing the radiator portion to radiate electromagnetic signals within the second frequency range.

In accordance with a further feature of the present invention, the slot includes a first elongated slot portion and a second elongated slot portion coupled to the first elongated slot portion forming a continuous slot, the second elongated slot portion being disposed approximately 90 degrees with respect to the first elongated slot portion.

In accordance with a yet another feature, the present invention includes a capacitor bridging the slot and capacitively coupling the first extending arm to the second extending arm.

The present invention, according to an embodiment, is a wireless communication device that includes a transceiver and an antenna coupled to the transceiver, where the antenna includes a U-shaped radiator portion having a first extending arm and a second extending arm parallel and adjacent the first extending arm and coupled to the first extending arm by a junction portion, the first and second extending arms and the junction portion defining a slot. A ground plane is physically coupled only to the first extending arm and a distributed feed element is disposed at least partially within the slot and is operable to radiate electromagnetic signals within a first frequency range and electrically excite at least portions of the radiator portion at at least a second frequency range having frequencies not within the first frequency range, thereby causing the radiator portion to radiate electromagnetic signals within the second frequency range

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

Figure 1:
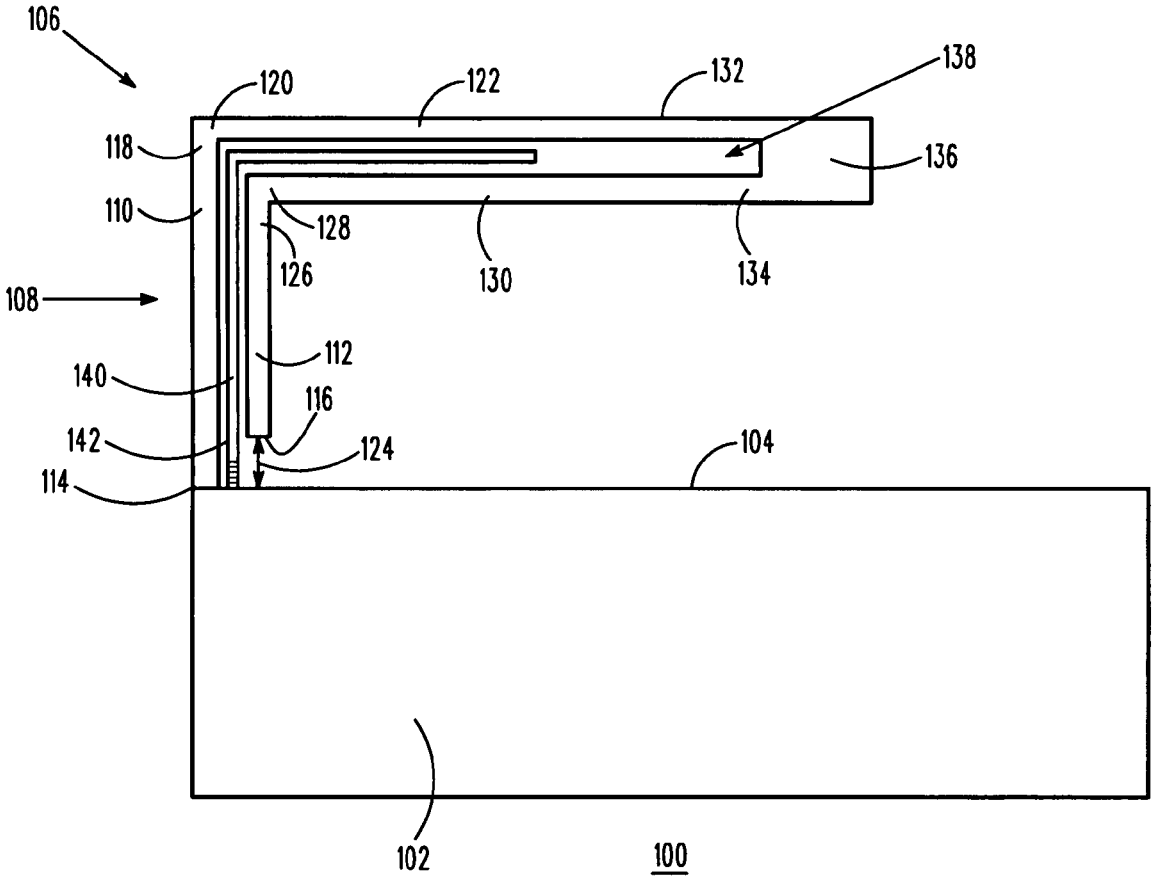
FIG. 1 is a plan view of a multi-band antenna, according to an embodiment of the present invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Embodiments herein can be implemented in a wide variety of ways using a variety of technologies that provide a novel and efficient multi-band antenna structure that includes a distributed feed element within a slot created by a folded monople element. The distributed feed element acts as a radiator at a first frequency range and as an exciter at other ranges, thereby providing a broadband antenna performance with a low-Q throughout.

An antenna is a transducer designed to transmit or receive radio waves, which are a class of electromagnetic waves. In other words, antennas convert radio frequency electrical currents into electromagnetic waves, and vice versa. Antennas are used in systems such as radio and television broadcasting, point-to-point radio communication, wireless LAN, radar and space exploration.

Physically, an antenna is a conductor that generates a radiating electromagnetic field in response to an applied alternating voltage and the associated alternating electric current. Alternatively, an antenna can be placed in an electromagnetic field so that the field will excite or induce an alternating current in the antenna and a voltage between its terminals. It is through these antennas that electronic wireless communication is made possible.

The electromagnetic (EM) "spectrum" is the range of all possible electromagnetic radiation. This spectrum is divided into frequency "bands," or ranges of frequencies, that are designated for specific types of communication. Many radio devices operate within a specified frequency range, which limits the frequencies on which the device is allowed to transmit.

EM energy at a particular frequency (f) has an associated wavelength (λ). The relationship between wavelength and frequency is expressed by:

$$\lambda = c/f$$

where c is the speed of light (299,792,458 m/s). It therefore follows that high-frequency EM waves have a short wavelength and low-frequency waves have a longer wavelength.

The Global System for Mobile communications (GSM) is the most popular standard for mobile phones in the world. GSM frequency bands or frequency ranges are the radio spectrum frequencies designated by the International Telecommunication Union for the operation on the GSM system for mobile phones.

GSM-850 and GSM-1900 are used in the United States, Canada, and many other countries in the Americas. GSM-850 is also sometimes called GSM-800 because this frequency range was known as the "800 MHz Band" when it was first allocated for Advanced Mobile Phone System (AMPS) usage in the United States in 1983.

GSM-850 uses the frequency band 824-849 MHz to send information from the Mobile Station to the Base Transceiver Station (uplink) and the frequency band 869-894 MHz for the other direction (downlink). GSM-1900 uses the frequency band 1850-1910 MHz to send information from the Mobile Station to the Base Transceiver Station (uplink) and the frequency band 1930-1990 MHz for the other direction (downlink).

The 850 MHz band is often referred to as "cellular," as the original analog cellular mobile communication system was allocated in this spectrum. PCS, an acronym for "Personal Communications Service," represents the original name in North America for the 1900 MHz band. Providers commonly operate in one or both frequency ranges.

GSM-1800 uses the frequency band 1710-1785 MHz to send information from the Mobile Station to the Base Transceiver Station (uplink) and the frequency band 1805-1880 MHz for the other direction (downlink). GSM-1800 is referred to as "DCS" in Hong Kong and the United Kingdom.

The Global Positioning System (GPS) is currently the only fully-functional Global Navigation Satellite System (GNSS). Utilizing a constellation of at least 24 Earth-orbiting satellites that transmit precise microwave signals, the GNSS enables a GPS receiver to determine its location, speed, and direction. The GPS operates, for navigational purposes, at the precise frequency of 1575.42 MHz.

The present invention, according to a first embodiment, provides, for the first time, a single internal antenna that efficiently operates (low-Q) within each of the GSM 850, DCS, AWS, and PCS bandwidths, as well as at the GPS frequency. The present invention, according to other embodiments, provides, for the first time, a single antenna that efficiently operates (low-Q) within the Ultra High Frequency (UHF) 380-520 MHz and 7/800 MHz bandwidths.

FIG. 1 shows a first embodiment of the antenna structure 100 of the present invention. The antenna structure 100 includes a ground plane 102. A ground plane, such as ground plane 102, is simply an area of electrically-conductive material, e.g., copper, and serves as a near-field reflection point for the antenna structure 100 when operating as described below. The ground plane 102 has a proximal edge 104 to which an element 106 is attached. The term "attached," as used herein, means that the antenna and the ground plane are in physical and electrical communication with one another. The ground plane 102 and element 106 do not necessarily have to be of the same material.

The function of the element 106 is to "match" the impedance of the air to the radio source that supplies the signals sent or interprets the signals received. The element 106, in this particular exemplary embodiment of the present invention, resembles an "L" shape and is of a continuously conductive material. For example, the element 106 can be all or partially formed from copper traces etched on a circuit board.

The element 106 includes a foot 108 with a first foot portion 110 and a second foot portion 112 spaced away from and parallel to the first foot portion 110. The first foot portion 110 is physically coupled to the proximal edge 104 of the ground plane 102 at a proximal end 114 thereof. In contrast, the corresponding proximal end 116 of the second foot portion 112 is not coupled to the ground plane 102. The end 116 of the second foot portion 112 defines a gap 124 between the second foot portion 112 and the ground plane 102. The dimensions of the gap 124 can be used for tuning the antenna 100 as the gap 124 defines a distributed capacitance value with the ground plane and also changes the coupling effect with the feed line 140 (explained below). The gap 124 determines the overall length of the arm which is an important tuning parameter. Therefore, the gap can be varied significantly (more that 6 mm) depending on how the antenna is tuned. However, typically, the dimensions of the antenna for most applications will be similar to FIG. 1, with the gap 124 being about 3-6 mm.

The first foot portion 110, at a distal end 118 thereof, is coupled to a proximal end 120 of a first leg portion 122 that is substantially perpendicular to the foot portions 110 and 112 and is substantially parallel to the proximal edge 104 of the ground plane 102. In the embodiment shown in FIG. 1, the width of the first foot portion 108 and the width of the first leg portion 122 is the same and uniform throughout their lengths. However, this is not necessary and can be altered in other embodiments to achieve proper tuning.

Similarly, the second foot portion 112, at a distal end 126 thereof, is coupled to a proximal end 128 of a second leg portion 130 that is substantially perpendicular to the first and second foot portions 110 and 112 and is substantially parallel to the first leg portion 122 and the proximal edge 104 of the ground plane 102. In the embodiment shown in FIG. 1, the width of the second foot portion 112 and the width of the second leg portion 130 is the same and uniform along their lengths. In addition, in the embodiment shown in FIG. 1, the width of the first foot portion 110 and the width of the first leg portion 122 is the same as the width of the second foot portion 112 and the width of the second leg portion 130. Although the uniformity of width is present in this embodiment, this property is not necessary and can be altered in other embodiments to achieve proper tuning.

As can be seen in FIG. 1, the foot portions 110 and 112 and the two leg portions 122 and 130 define a continuous slot 138. The slot 138 is open at a first end thereof due to the fact that the proximal end 116 of the second foot portion 112 is spaced away from the proximal edge 104 of the ground plane 102 by the distance 124. However, the opposite end of the slot 138 is closed by a junction portion 136. The junction portion 136 couples the first leg portion 122 and the second leg portion 130, at their distal ends 132, 134, respectively.

The presently inventive antenna 100 has a distributed feed bar 140 disposed within a portion of the slot 138. The distributed feed bar 140 can be any conductive material that is fed at a point, such as a monopole. The distributed feed bar 140 can be etched onto a printed circuit board for ease of manufacturing and to maintain a consistent separation from the other element portions. For most applications, the length of the feed bar 140 is approximately about ¼-lambda for high band applications (i.e., PCS, DSC, AWS bands), and the outer arm is about ¼-lambda for the low band (i.e., GSM 850). The method in which one selects the distance/dimensions only depends on how one wants to get the antenna tuning—i.e. how to cause the antenna to resonate at the right frequency for specific applications. If the antenna is used for other applications/bands apart from the traditional cellular phone applications, these dimensions scale With the frequency. Therefore, the well-known quarter wave tuning is a sufficient estimation, although the invention is not so limited.

Figure 2:
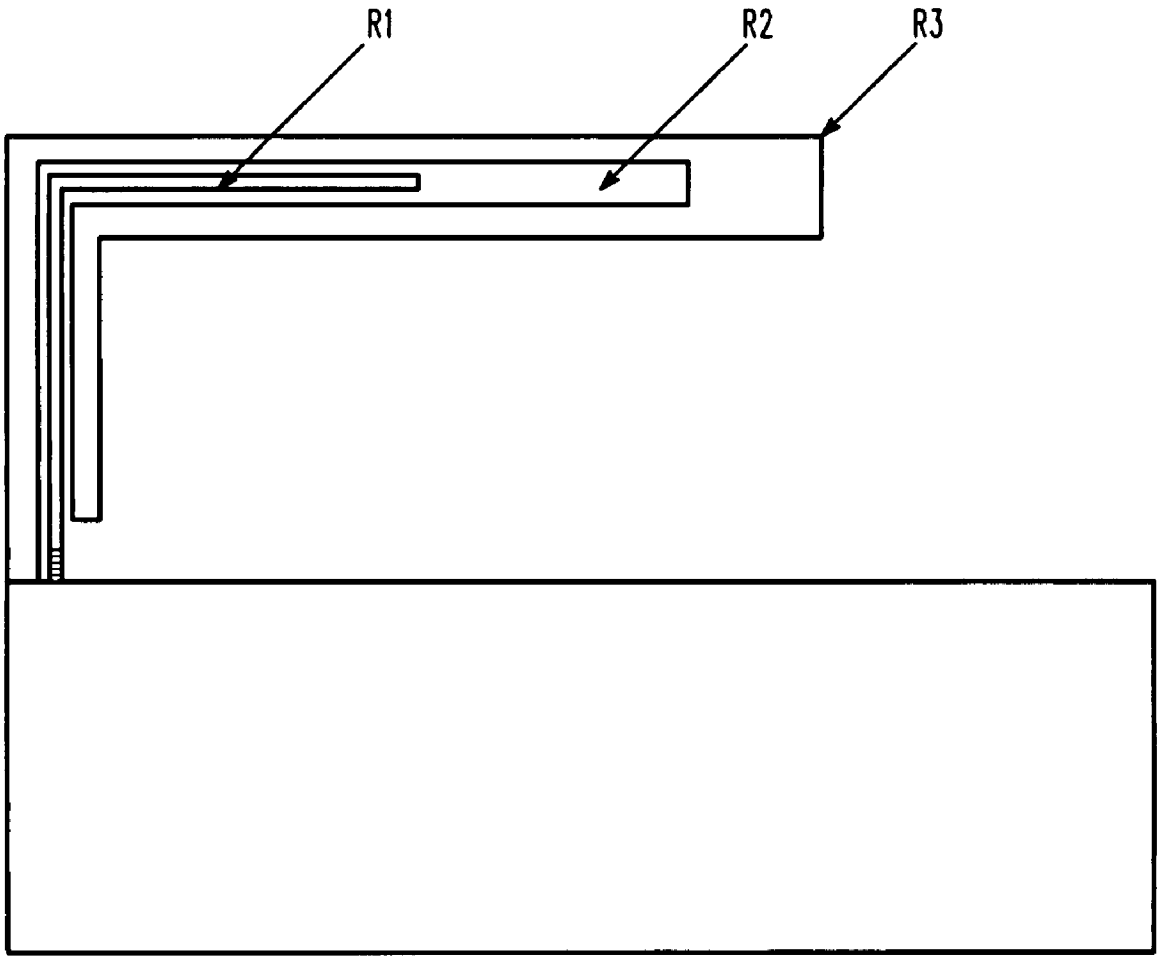
FIG. 2 is a plan view of the antenna of FIG. 1 and identifies various radiation areas thereof.

In one exemplary embodiment, the distributed feed bar 140 is fed at its proximal end 142. Upon being fed, as is illustrated in FIG. 2, the distributed feed bar 140 serves multiple functions. In a first resonant mode R1, within a first specified frequency band, the distributed feed bar 140 resonates and serves as a radiator and receiver of electromagnetic radiation. In a second resonant mode R2, within a second frequency band, the distributed feed bar 140 excites the slot 138 and the slot 138, itself, serves as a resonator and receiver. In a third resonant mode R3 of the antenna 100, within a third frequency band, the outer element 110, 122, 136, 130, and 112 serves as a resonator and receiver.

In an embodiment of the present invention, the first resonant mode R1 is at a higher frequency than the other two resonant modes R2 and R3. The third resonant mode R3 is at a lower frequency than the other two resonant modes R1 and R2. For example, the frequency R1 could be the frequency range of the GSM 1900 (PCS) and AWS bands; the frequency R2 could be, for example, the frequency range of the GPS band; and the frequency R3 could be, for example, the frequency range of the GSM 850 (GSM 800) band. The frequency ranges, however, are dependant on the geometric size of the antenna components.

Figure 3:
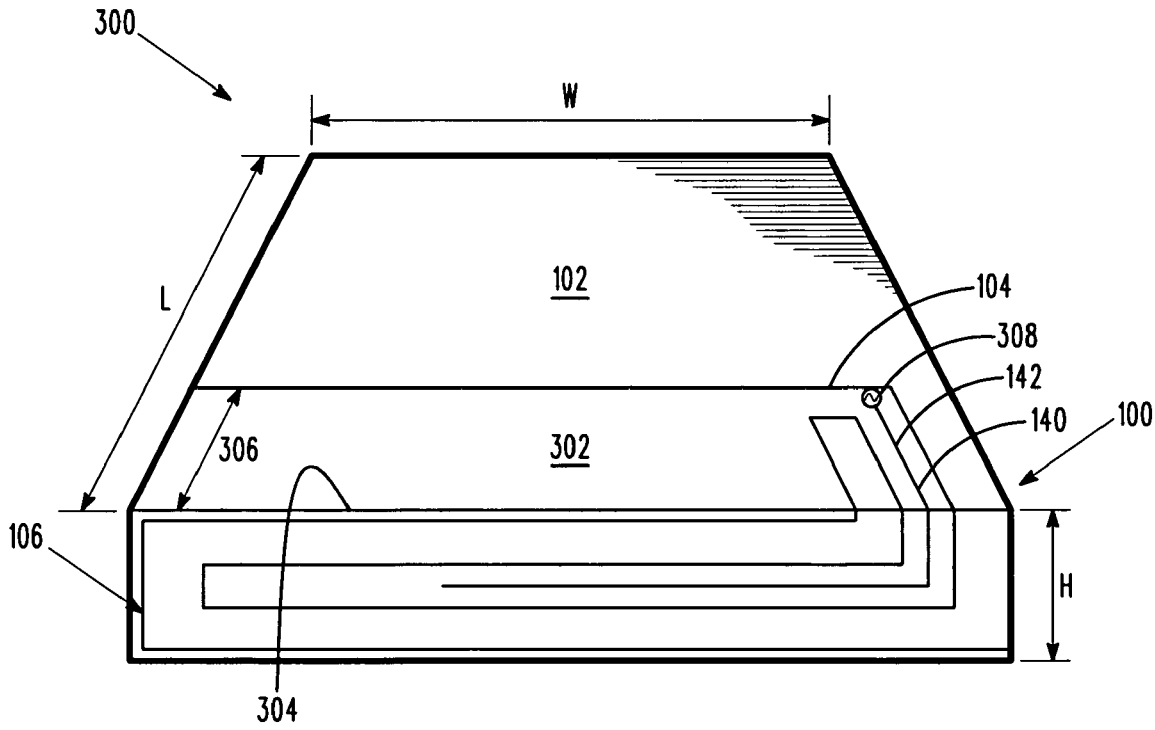
FIG. 3 is a perspective view of a wireless communication device with the antenna of FIG. 1 on external surfaces thereof, according to an embodiment of the present invention.

FIG. 3 shows a practical implementation of the presently inventive antenna 100 as applied to a wireless communication device 300. The device 300 is of a rectangular box shape that is well known to those familiar with cellular telephones. For instance, the length L of the device, in one embodiment, is about 79 mm, the width W is about 42 mm, and the height H is about 7 mm. In this example, the ground plane 102 resides on the rectangular back surface 302 of the device 300, but does not extend to the end 304 of the device 300. This distance 306 between the upper edge 104 of the ground plane 102 and the end 304 is referred to as the keep-out zone for electronics. The distance 306 plays an important role in determining the resonant frequency at which the antenna 100 operates and, in one embodiment, is about 14 mm. The lack of interfering components in the keep-out zone reduces the number of parasitics affecting the antenna's performance.

As is shown in FIG. 3, the element 106 and the distributed feed bar 140 fold over so that portions of the element 106 and the distributed feed bar 140 are not in the same plane as the ground plane 102, as was shown in FIG. 2. More specifically, portions of the element 106 and distributed feed bar 140 are perpendicular to the ground plane in two separate planes. The folding over advantageously reduces the length L of the antenna, and, therefore, the entire device, even further.

As an example of just one way to drive the inventive antenna, the distributed feed bar 140 can be fed with a signal originating from a transceiver within or external to the device 300. In one embodiment, the feed signal originates within the device 300 and then penetrates a portion of the ground plane 102, while remaining isolated from the ground plane 102. The isolation can be accomplished by keeping the signal within a coaxial cable. The signal then runs along the surface of the ground plane 102, still electrically isolated, and is then directly connected to the proximal end 142 of the distributed feed bar 140. This transceiver signal is represented as signal 308 in FIG. 3. Of course, there are many other ways to feed the antenna with or receive radio signals.

Figure 4:
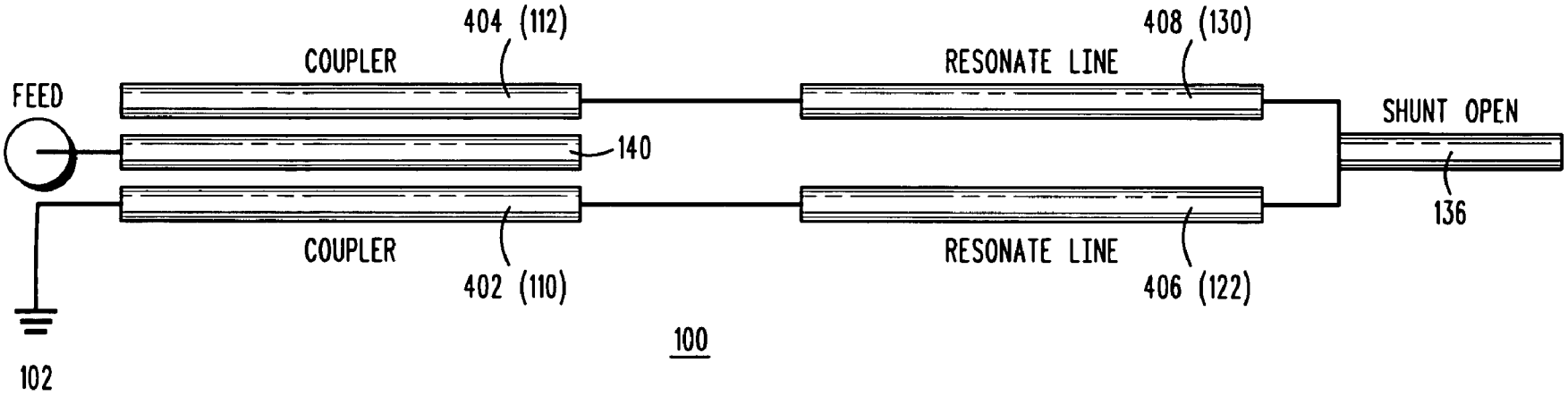
FIG. 4 is a schematic and block circuit diagram of the antenna of FIG. 1, according to an embodiment of the present invention.

FIG. 4 shows a representational schematic view of the antenna 100 shown in FIGS. 1-3. FIG. 4 illustrates how various portions of the antenna 100 perform specific functions, i.e. resemble known circuit components. Specifically, the feet 110 and 112 and portions of the leg portions 122 and 130 that are adjacent to and sandwich the distributed feed bar 140 function as electromagnetic couplers 402 and 404. That is, a potential is induced on those portions of the element 110, 122, 130, and 112 corresponding to an oppositely polarized charge on the distributed feed bar 140. Coupler 402 corresponds to the first foot 110, which is physically coupled to the ground plane 102, and is shown as grounded. The portions of the leg portions 122 and 130 that are not adjacent the distributed feed bar 140, i.e., slot portions beyond the extension of the distributed feed bar 140, electrically behave as resonant lines 406 and 408. Finally, in the embodiment shown in FIGS. 1-3, the junction portion 136 appears electrically as a shunt open. The first coupler 402, the second coupler 404, the first resonant line 406, the second resonant line 408, and the shunt open 136 define the slot 138. The slot 138 can be bent at an approximately 90-degree angle, as shown in FIG. 1. The slot 138 is shown as rectangular in the figures. The slot, however, is not restricted to an even dimension and, in one embodiment, can be tapered or otherwise have non-uniform dimensions.

The inventive antenna structure, which has just been described, advantageously provides efficient communication in the GSM 850, DCS, PCS, and GPS bandwidths, as well as the Bluetooth (2.4-2.4835 GHz) and AWS (Advanced Wireless Services—1710 to 1755 MHz and from 2110 to 2155 MHz) frequencies.

Figure 5:
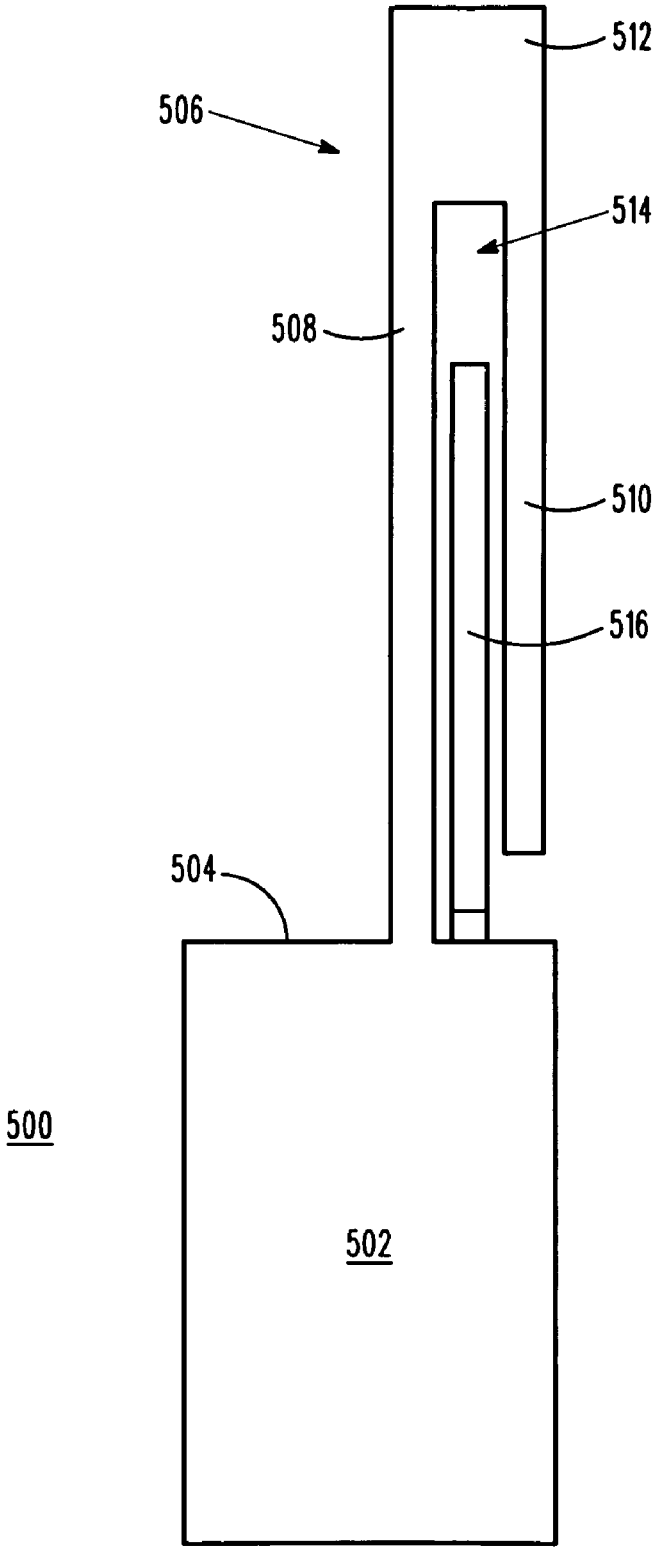
FIG. 5 is a plan view of a multi-band antenna with an extended rectangular slot, according to another embodiment of the present invention.

Wireless devices suitable for implementation of the present invention extend beyond cellular telephones to other wireless communication devices. One such device is a portable radio. Many known radios operate in the UHF band (between 380 and 520 MHz) and the "7/800" band (between 764 and 870 MHz). For applications where space is not as limited, the antenna 100 does not have to be "L" shaped, as was shown in FIGS. 1-3. Accordingly, FIG. 5 shows an example of an antenna 500 useful for radio applications. The antenna 500 has the same components as the antenna 100 in FIGS. 1-3, with the exception of the removal of the approximately 90-degree bend.

Specifically, the antenna 500 has a ground plane 502 with an upper proximal edge 504. An element 506, which includes a first extending arm 508, a second extending arm 510, and a junction portion 512, is provided above the upper proximal edge 504 of the ground plane 502. The first extending arm 508 of the element 506 is physically coupled to the ground plane 502 at the upper proximal edge 504. The first extending arm 508 is electrically analogous to a combination of the foot 110 and leg 122 of FIG. 1. Similarly, the second extending arm 510 is analogous to a combination of the foot 112 and leg 130 of FIG. 1.

The element 506 resembles an inverted "U" shape which is closed on one side by the junction portion 512. Within the elongated rectangular slot 514 formed by the "U" shape, or at least partially within the slot 514, is a feed bar 516. The feed bar 516 performs a similar function as the distributed feed bar 140, which is to induce a magnetic field onto the element structure 506 at certain frequencies.

Figures 6, 6A:
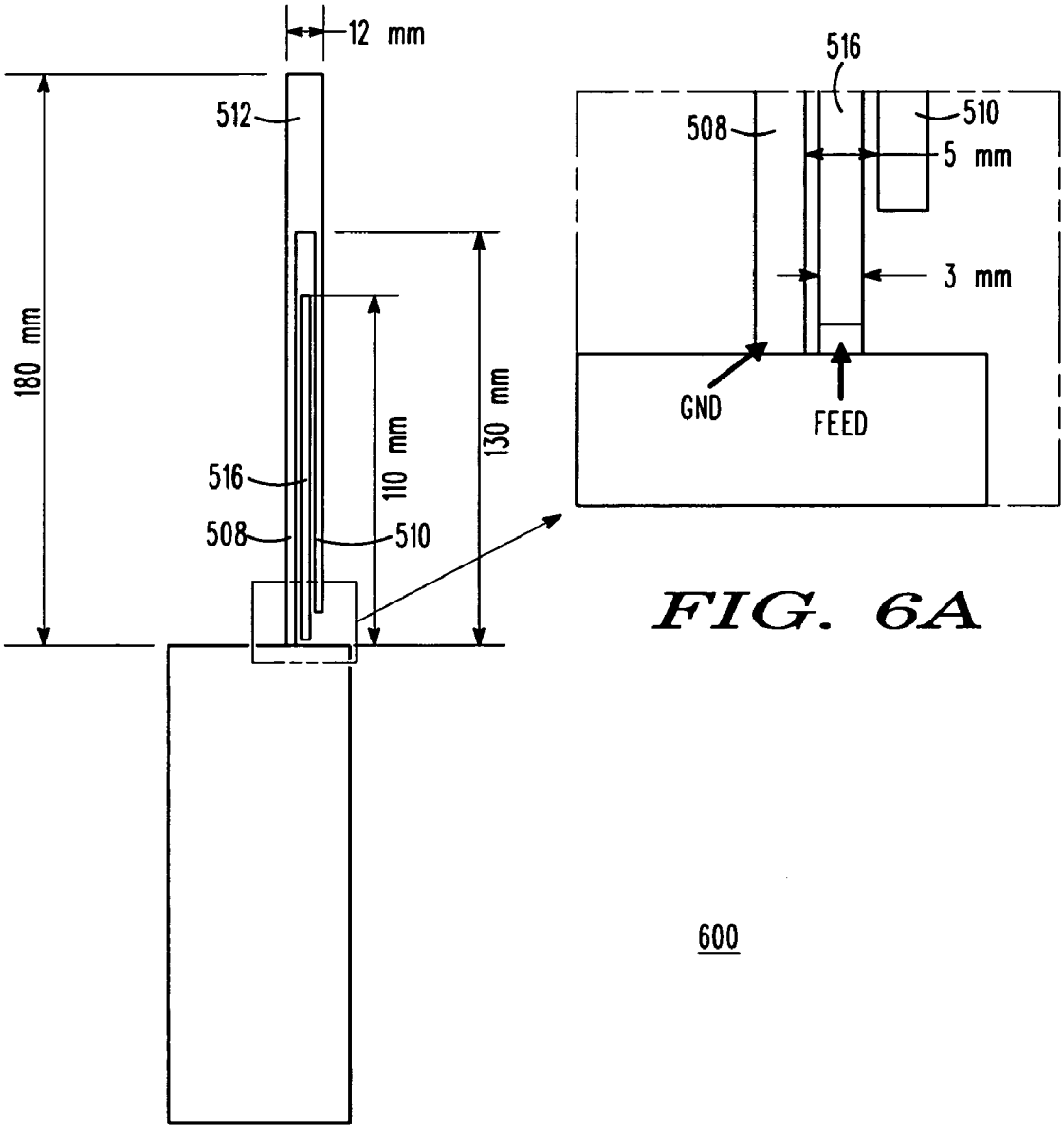
FIG. 6 is a plan view of a multi-band antenna with exemplary dimensions and with an extended rectangular slot, according to an embodiment of the present invention.
FIG. 6*a* is an enlarged fragmentary plan view of a portion of the antenna of FIG. 6 with exemplary dimensions.
Figure 7:
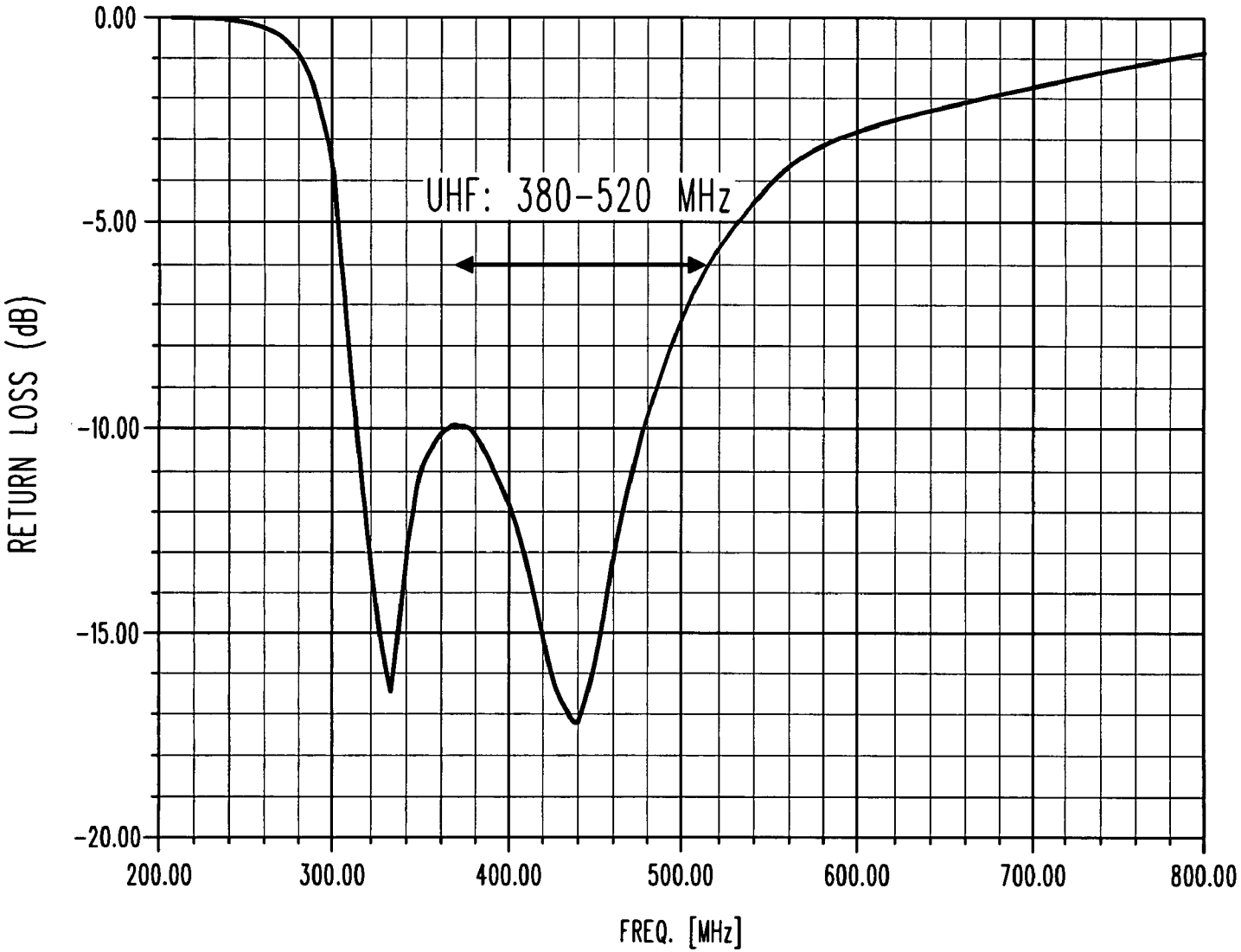
FIG. 7 is a graph showing return loss of the antenna of FIG. 6 across the frequency band of 200-800 MHz.

As is known to those of skill in the art of antennas, dimensions and orientations of antenna elements, ground planes, and feed elements are highly sensitive to the performance of the antenna This principle is illustrated in the following figures, where the inventive antenna, with the feed bar structure, has varying dimensions. For instance, FIG. 6 shows exemplary dimensions for the inventive antenna 600 tuned to operate in the UHF band (380-520 MHz) according to one embodiment of the present invention. The dimensions shown in FIG. 6, however, are merely exemplary and the invention is in no way intended to be limited to those shown. FIG. 7 shows an exemplary performance curve, between the frequencies of 200-800 MHz, of an antenna having the shape and dimensions of the antenna 600 of FIG. 6.

Figures 8, 8A:
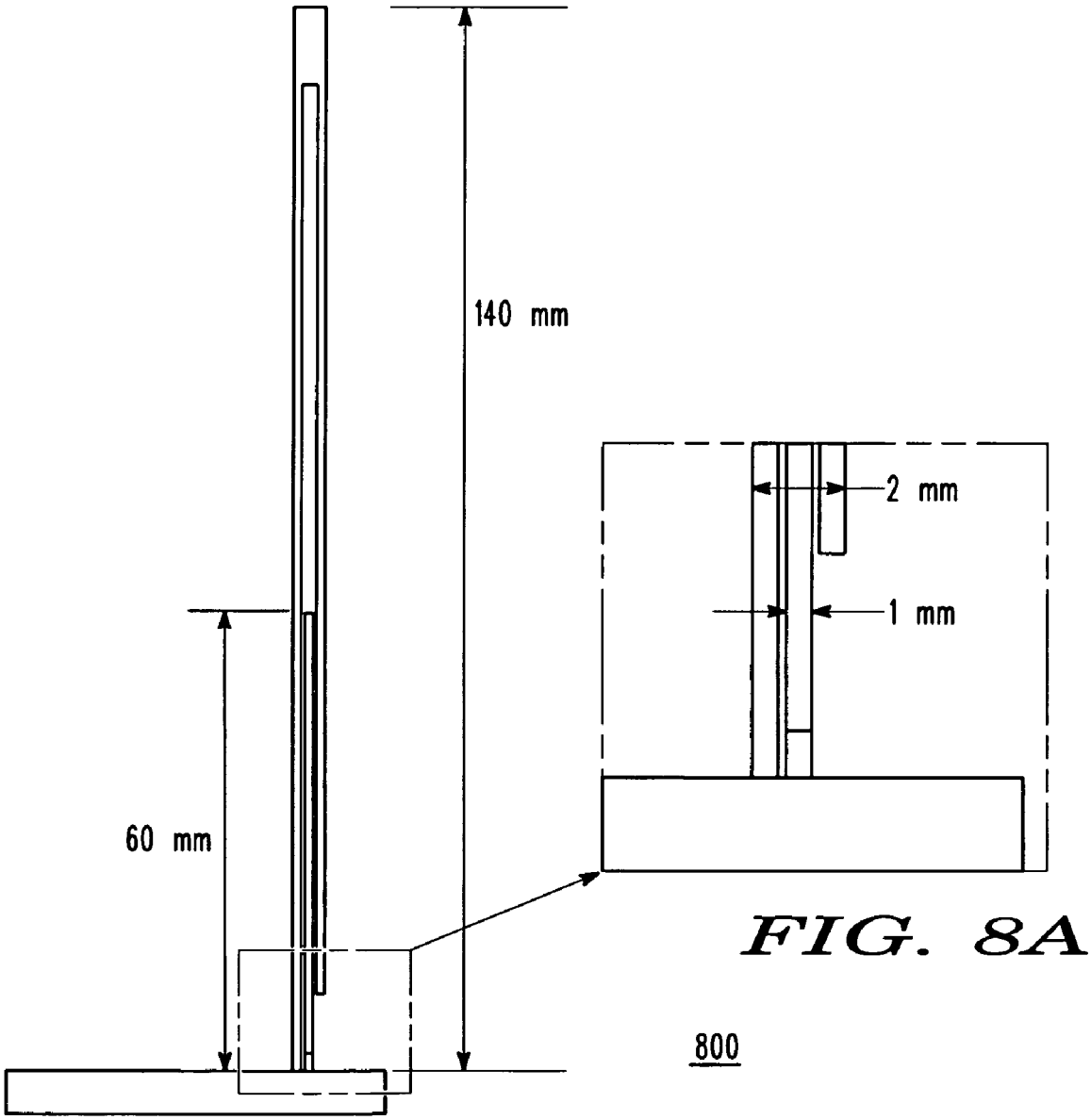
FIG. 8 is a fragmentary plan view of a multi-band antenna with exemplary dimensions and with an extended rectangular slot, according to an embodiment of the present invention.
FIG. 8*a* is an enlarged fragmentary plan view of a portion of the antenna of FIG. 8 with exemplary dimensions.

FIG. 8 shows an embodiment of the present invention tuned for the UHF frequencies 380-520 MHz. In this embodiment, the element and feed bar have the dimensions shown in FIG. 8, which vary from those exemplary dimensions of FIG. 6. The dimensions shown in FIG. 8, however, are merely exemplary and the invention is in no way intended to be limited to those shown.

Figure 9:
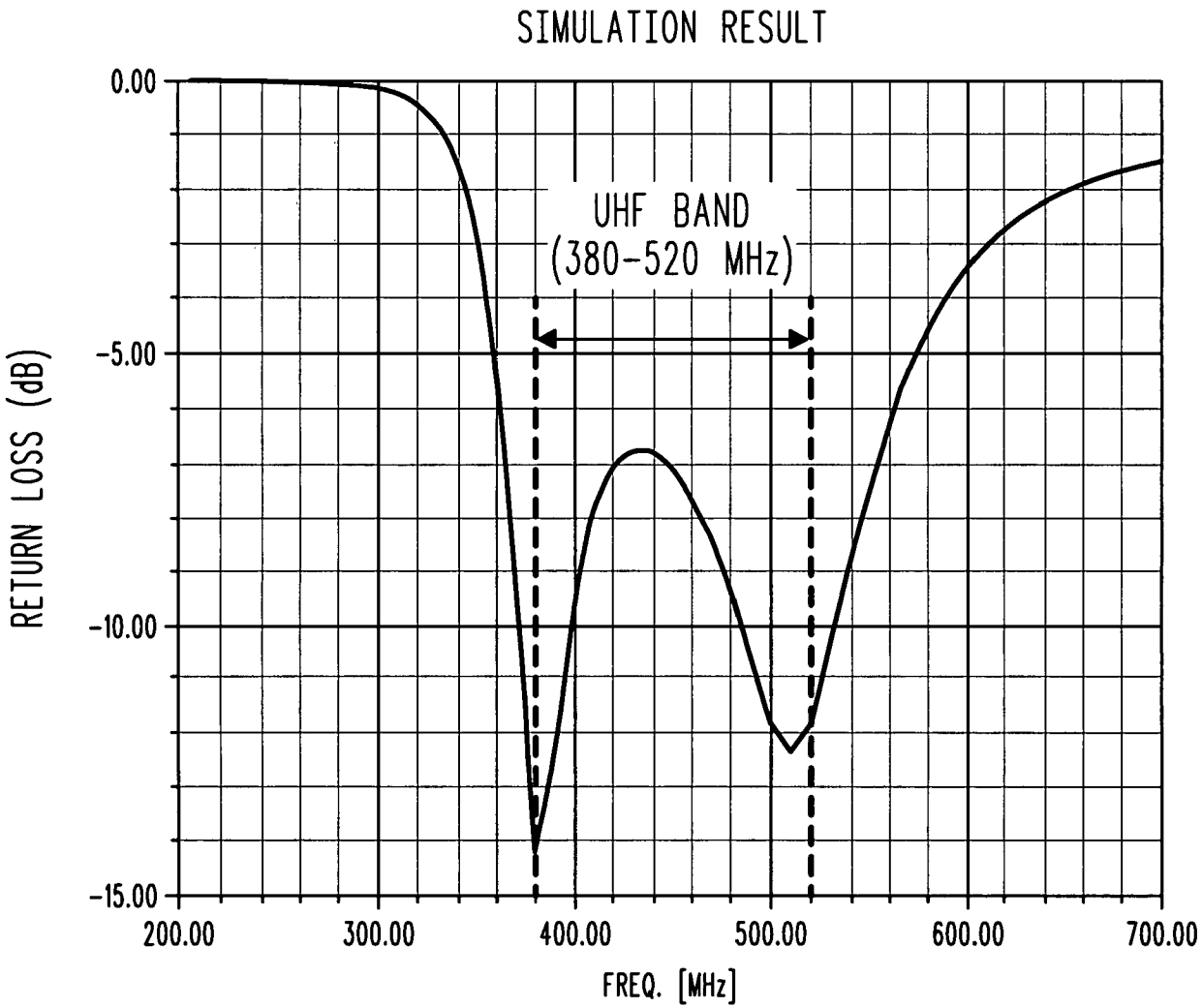
FIG. 9 is a graph showing return loss of the antenna of FIG. 8 across the frequency band of 200-700 MHz.

FIG. 9 shows an exemplary performance curve, between the frequencies of 200-700 MHz, of an antenna having the shape and dimensions of the antenna 800 of FIG. 8.

Figure 10:
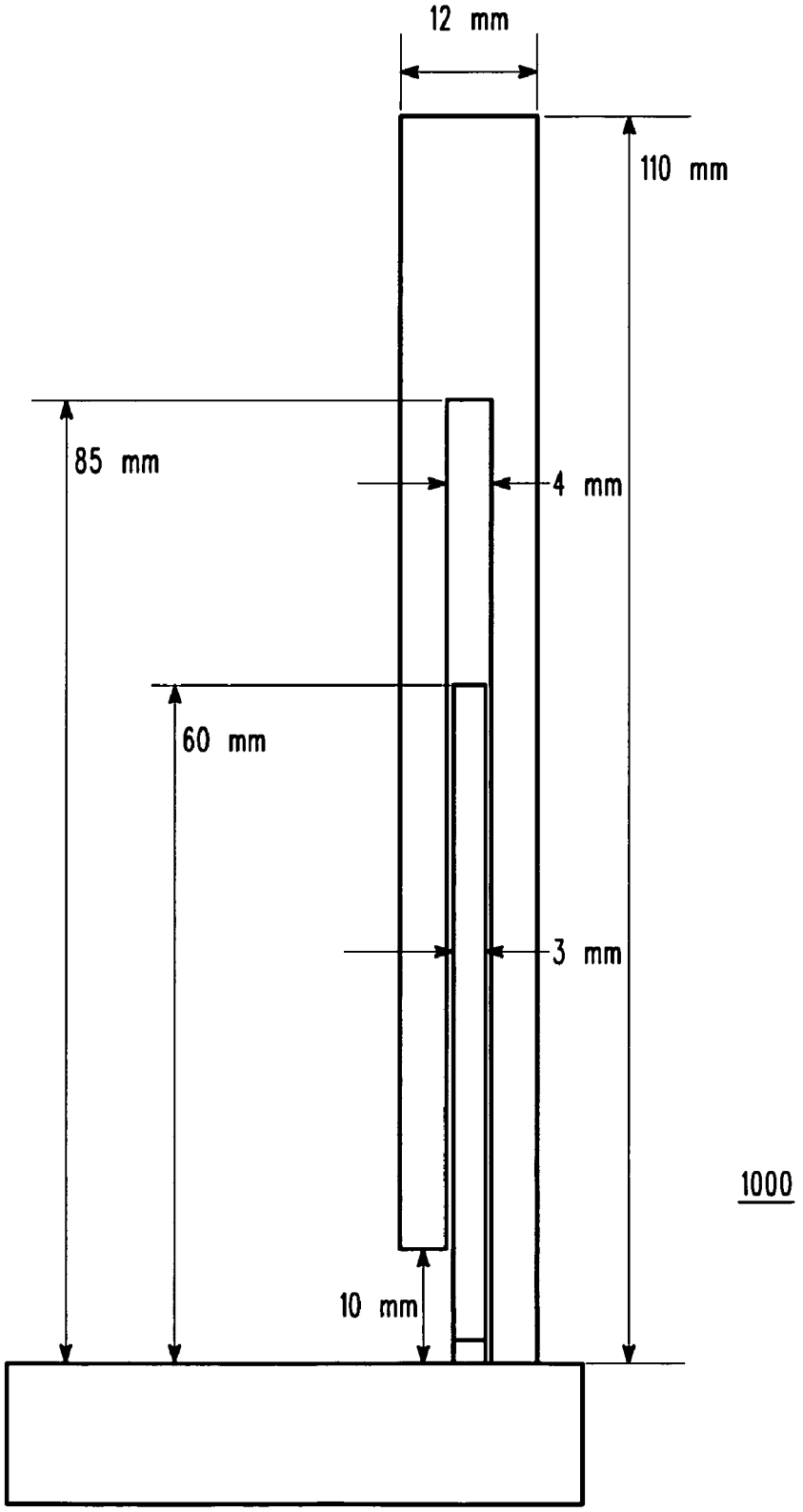
FIG. 10 is a fragmentary plan view of a multi-band antenna with exemplary dimensions and with an extended rectangular slot, according to an embodiment of the present invention.

FIG. 10 shows an embodiment of the present invention tuned for the upper half (380-520 MHz) of the UHF frequencies and for the 7/800 band. In this embodiment, the element and feed bar have the dimensions shown in FIG. 10, which vary from those exemplary dimensions of FIGS. 6 and 8. The dimensions shown in FIG. 10, however, are merely exemplary and the invention is in no way intended to be limited to those shown.

Figure 11:
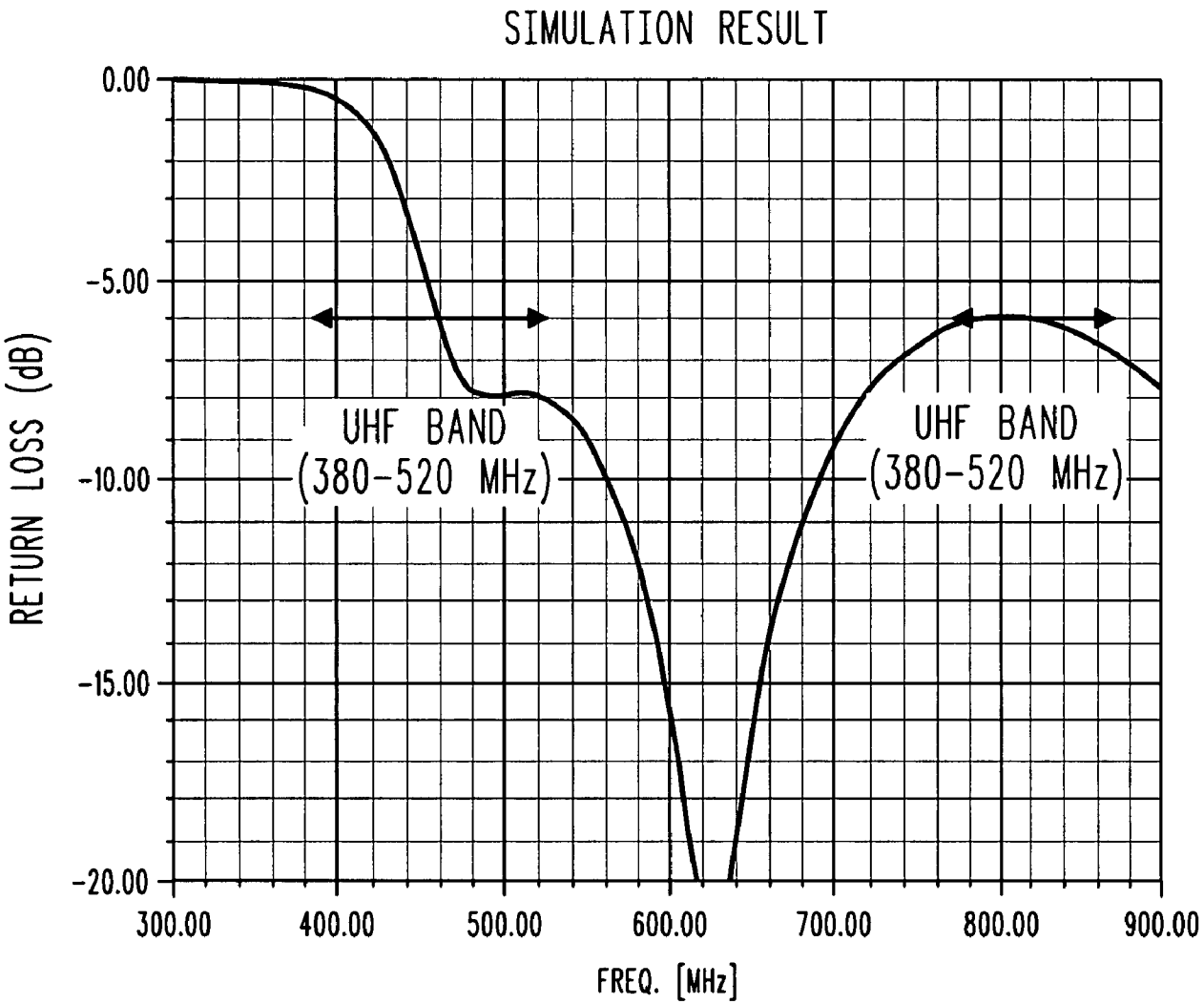
FIG. 11 is a graph showing return loss of the antenna of FIG. 10 across the frequency band of 300-900 MHz.

FIG. 11 shows an exemplary, performance curve, between the frequencies of 300-900 MHz, of an antenna having the shape and dimensions of the antenna 1000 of FIG. 10.

Figure 12:
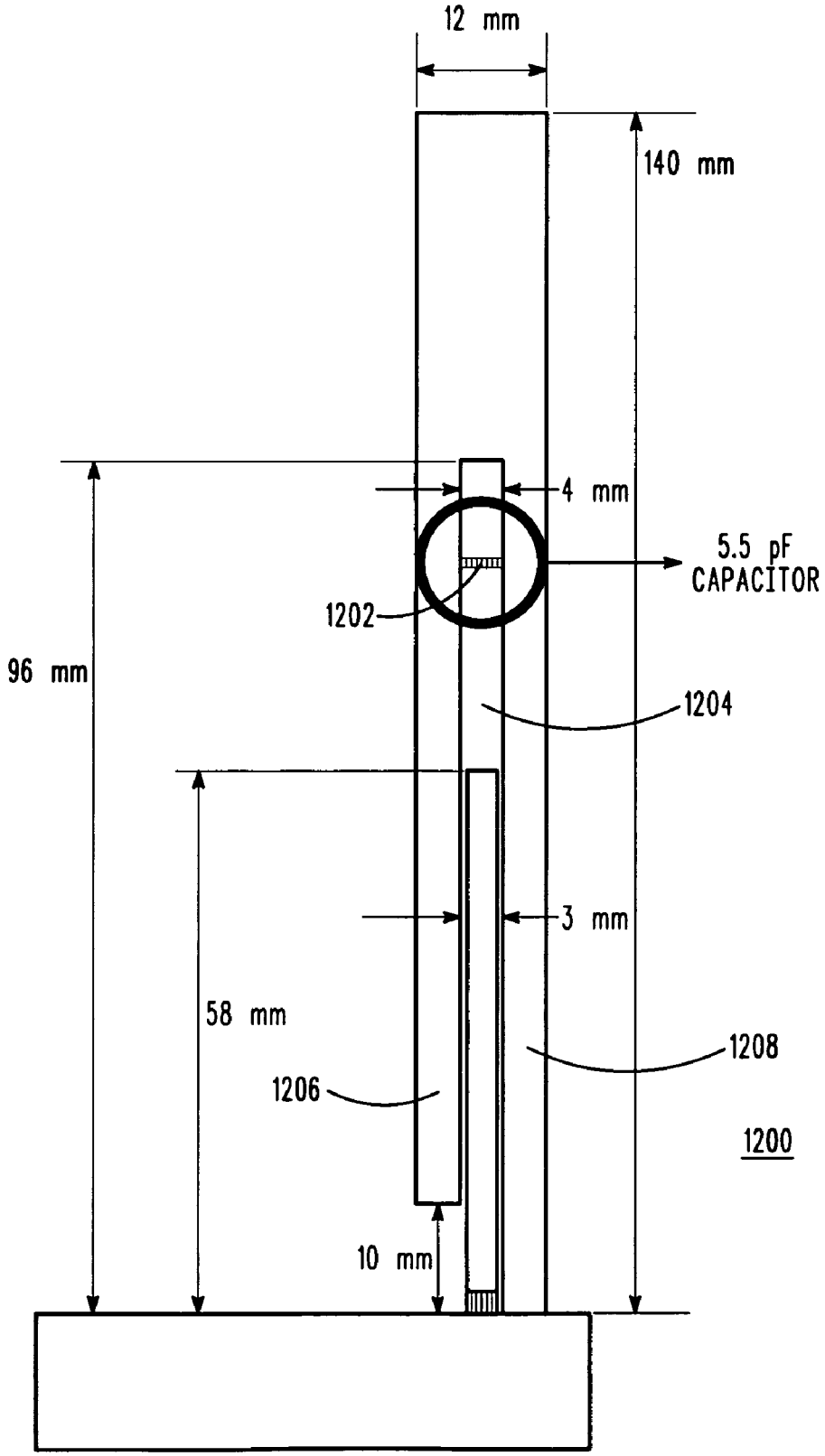
FIG. 12 is a fragmentary plan view of a multi-band antenna with exemplary dimensions and with an extended rectangular slot and a capacitive element, according to an embodiment of the present invention.

FIG. 12 shows an embodiment of the present invention tuned for the full (380-520 MHz) UHF frequency band and for the 7/800 band. In this embodiment, a capacitive element 1202 is inserted within the gap 1204 bridging from a first leg 1206 to a second leg 1208. The capacitive element 1202 provides improved coupling between the legs 1206 and 1208. In the particular embodiment shown, the capacitor 1202 has a value of 5.5 pF. This capacitor value, however, is merely exemplary and other values can be used.

Exemplary dimensions for the element and feed bar of FIG. 12 are shown. These dimensions vary from those exemplary dimensions of FIGS. 6, 8, and 10 and result in a different performance over a frequency range. The dimensions shown in FIG. 12, however, are merely exemplary and the invention is in no way intended to be limited to those shown.

Figure 13:
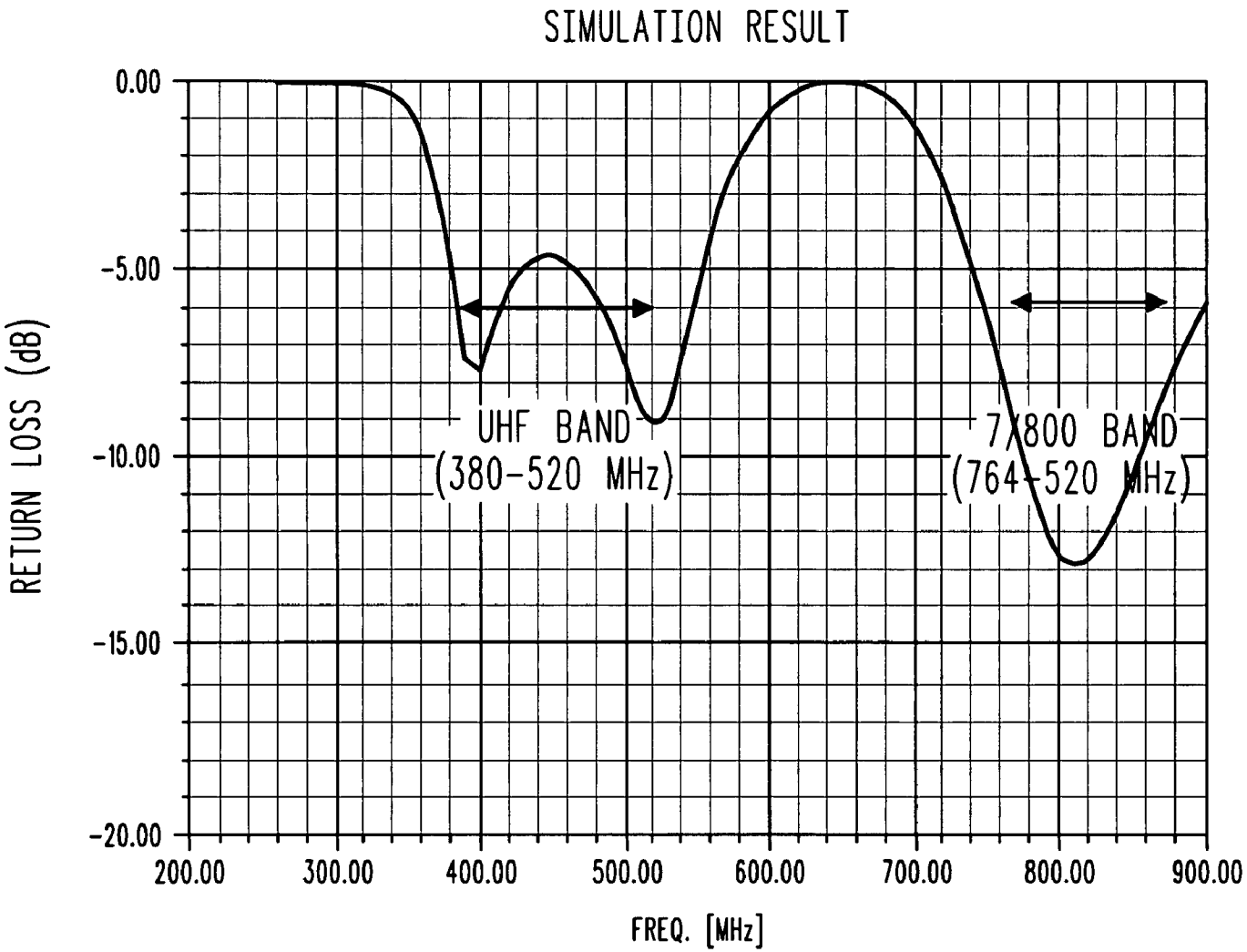
FIG. 13 is a graph showing return loss of the antenna of FIG. 12 across the frequency band of 200-900 MHz.

FIG. 13 shows an exemplary performance curve, between the frequencies of 200-900 MHz, of an antenna having the shape and dimensions of the antenna 1200 of FIG. 12.

Conclusion

As should now be clear, embodiments of the present invention provide a low-profile, low cost, high performance UHF and 7/800 dual band antenna solution for use in hand-held communication devices.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. The term "about" or "approximately," as used herein, applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

What is claimed is:

1. An antenna comprising:

a distributed feed element;

a first coupler portion and a second coupler portion sandwiching the distributed feed element, the first coupler portion having first and second ends, the second coupler portion having first and second ends;

a first resonant line portion having a first resonant end physically coupled to the second end of the first coupler portion and a second resonant end;

a second resonant line portion having a first resonant end physically coupled to the second end of the second coupler portion and a second resonant end;

a shunt portion coupling the second resonant end of the first resonant line portion to the second resonant end of the second resonant line portion, the first coupler portion, the second coupler portion, the first resonant line portion, the second resonant line portion, and the shunt portion defining a slot;

a capacitive element bridging the slot and capacitively coupling the first coupler portion to the second coupler portion; and a ground plane physically coupled only to the first end of the first coupler portion.

2. The antenna according to claim 1, wherein:

the slot is rectangular.

3. The antenna according to claim 1, wherein:

the first coupler portion, the second coupler portion, the first resonant line portion, and the second resonant line portion define an approximately 90-degree bend in the slot.

4. The antenna according to claim 3, further comprising:

an approximately 90-degree bend in the distributed feed element that coincides with the bend in the slot.

5. The antenna according to claim 1, wherein:

the first end of the second coupler portion defines a gap between the second coupler portion and the ground plane.

6. The antenna according to claim 5, wherein:

the gap is between approximately 3 mm and approximately 6 mm wide.

7. The antenna according to claim 1, wherein:

the first resonant line portion is substantially parallel to the second resonant line portion; and the first and second resonant line portions are substantially perpendicular to the first and second coupler portions.

8. The antenna according to claim 7, wherein:

the ground plane has a proximal edge; and the first and second resonant line portions are substantially parallel to the proximal edge of the ground plane.

9. An antenna, comprising:

a ground plane having a proximal edge and an element attached thereto, the element including:

a first foot portion having a proximal end and a distal end, the proximal end physically coupled to the proximal edge of the ground plane;

a second foot portion spaced away from and substantially parallel to the first foot portion, the second foot portion having a proximal end and a distal end, the proximal end spaced away from the proximal edge of the ground plane to define a gap between the second foot portion and the ground plane;

a first leg portion substantially perpendicular to the first and second foot portions and having a proximal end and a distal end, the proximal end coupled to the distal end of the first foot portion;

a second leg portion spaced away from and substantially parallel to the first leg portion, the second leg portion having a proximal end and a distal end, the proximal end coupled to the distal end of the second foot portion, the first and second foot portions and the first and second leg portions defining a continuous slot;

a capacitive element disposed within a portion of the slot and capacitively coupling the first and second foot portions; and a junction portion coupling the first and second leg portions at their respective distal ends;

a first resonant mode at a first frequency band;

a second resonant mode at a second frequency band; and a third resonant mode at a third frequency band;

wherein:

in the first resonant mode, the capacitive element resonates and receives electromagnetic radiation;

in the second resonant mode, the capacitive element excites the slot and the slot resonates and receives electromagnetic radiation; and in the third resonant mode, the first and second foot portions, the first and second leg portions, and the junction portion resonate and receive electromagnetic radiation.

10. The antenna according to claim 9, wherein:

the slot is rectangular.

11. The antenna according to claim 9, wherein:

the first and second foot portions and the first and second leg portions define an approximately 90-degree bend in the slot.

12. The antenna according to claim 9, wherein:

the first frequency band is higher than the second and third frequency bands; and the second frequency band is higher than the third frequency band.

13. The antenna according to claim 9, wherein:

the gap is between approximately 3 mm and approximately 6 mm wide.

14. The antenna according to claim 9, wherein the element is L-shaped.

* * * * *